United States Patent [19]

Venable

[11] 4,423,602

[45] Jan. 3, 1984

[54] SYNERGISTIC AIR CONDITIONING AND REFRIGERATION ENERGY ENHANCEMENT METHOD

[75] Inventor: Bennett M. Venable, Northport, N.Y.

[73] Assignee: Certified Energy Corp., Jericho, N.Y.

[21] Appl. No.: 338,183

[22] Filed: Jan. 8, 1982

[51] Int. Cl.[3] ..... F25B 27/02

[52] U.S. Cl. ..... 62/238.6

[58] Field of Search ..... 237/2 B; 62/238.6, 259.4

[56] References Cited

U.S. PATENT DOCUMENTS

| | | | |
|---|---|---|---|
| 1,831,880 | 11/1931 | Pierce | 62/259.4 X |
| 3,188,829 | 6/1965 | Siewert et al. | 62/238.6 X |
| 4,241,588 | 12/1980 | Murphy et al. | 62/238.6 |
| 4,254,630 | 3/1981 | Geary | 62/238.6 X |
| 4,293,093 | 10/1981 | Raymond et al. | 62/238.6 |
| 4,314,456 | 2/1982 | Harnish | 62/238.6 X |
| 4,321,797 | 3/1982 | Yaeger | 62/238.6 X |
| 4,330,309 | 5/1982 | Robinson, Jr. | 62/238.6 X |
| 4,367,634 | 1/1983 | Bolton | 62/238.6 |

*Primary Examiner*—Lloyd L. King

*Attorney, Agent, or Firm*—Nolte and Nolte

[57] ABSTRACT

The invention is an energy saving method that subcools previously condensed refrigerant causing an increase in the net refrigeration effect. A water pump is used to circulate cold water stored in a tank through a counter flow heat exchanger which is connected to the liquid refrigerant line just prior to the expansion device and after the existing condenser. Excess sensible heat is thus transferred to the water storage unit. The effectiveness of water cooling is thus achieved and yet water conservation is achieved since water is dispersed only when excessive sensible temperature has been accumulated in the storage unit. The temperature of the water in the storage tank is maintained by an aquastat mounted on the top which activates a solenoid dispersing heated water and admitting cool water as required. The subcooling of liquid refrigerant results in an increase in the heat collecting capacity of a refrigeration system (effective tonnage) and the reduction of excessive compressor head pressure thus reducing the electric power requirements by reducing running time and reducing the electric power needed to operate the compressor. In addition, reduced compressor head pressure reduces maintenance and repair costs by extending the compressor mean time between failure.

2 Claims, 2 Drawing Figures

SYNERGISTIC AIR CONDITIONING AND REFRIGERATION ENERGY ENHANCEMENT METHOD

BACKGROUND OF THE INVENTION

In recent years the use of air cooled refrigeration equipment has become commonplace in medium sized businesses such as restaurants, grocery stores, shopping centers, single story manufacturing plants, etc. Prior art, pre-assembled, medium sized, air-cooled refrigeration systems in the 3 to 8 ton range find wide application for air conditioning and the cooling of freezers and refrigerators in these commercial locations. The basic components of such refrigeration systems employ a compressor, a condenser, an expansion valve, and an evaporator all of which are connected together by tubing which allows refrigerant to flow through the system, collecting heat at the evaporator and dissipating heat at the condenser. This refrigeration process is well understood art and operates quite efficiently when the compressor and condenser units and the refrigerant lines leading to and from these units are located in an ambient environment of 70°–75° F. or less. However, hot summer days bring soaring ambient temperatures with the result that the liquid refrigerant approaches the expansion valve at well over 100° F. This enormous, unwanted excursion in refrigerant temperature has two undesirable effects. First it results in a significant reduction in the system's net refrigerating effect causing the compressor to run longer than would otherwise be the case, thereby consuming higher electric power to remove the same quantity of heat. The second undesirable effect of elevated refrigerant temperature is to significantly raise the compressor head pressure causing the compressor to work harder and as a consequence draw electric current per unit of time and reduce the compressor's mean time between failure. Prior art water cooled refrigeration systems tend to overcome the air cooled refrigeration system deficiencies. However, medium sized water cooled refrigeration systems present their own deficiencies as is well understood in those practiced in the art. It is impractical and costly to continuously draw cooling water from a water source and dispose of it in a drain. Prior art water cooled refrigeration systems overcome this problem by recirculating water through a mechanism, such as a water tower, which eliminates much of the heat collected by the cooling water as it flows through the refrigeration system condenser. Typically, water tower mechanisms are able to cool the water to a temperature of 7° or 8° F. above the wet bulb temperature as opposed to the ambiant temperture. On hot and humid summer days the recirculated cooling water temperature may stabilize at a level of 30°–40° F. above the cooling water temperature at its source which has a typical temperature of 50°–65° F. As a consequence the refrigerant retains sensible heat and significant subcooling of the refrigerant does not take place on warm and humid days even though the refrigerant sensible temperature will be lower than a corresponding air cooled system. It is well known in the refrigeration industry that cooling water drawn from water mains or wells contains significant levels of dissolved salts and minerals which precipitate out of solution and deposit themselves on surfaces being cooled by the cooling water. This phenomenon occurs within prior art water cooled refrigeration condensers and water towers referenced herein. Accordingly it is common practice to design said devices with accessible cleaning ports or other means to facilitate periodic maintenance.

OBJECTS OF THE INVENTION

1. It is therefore a general object of the invention to provide a means to significantly reduce the electric power consumption of air conditioning and refrigeration systems.

2. Another object of the invention is to provide a device which is readily adaptable for use as part of a new airconditioning and refrigeration system or as an addition to an old system, of varying capacities, without adversely affecting their performance and reliability in other respects.

3. Yet another object of the invention is to provide such a device which is self contained, rugged, and uncomplicated for installation as a field modification to already installed airconditioning and refrigeration systems.

4. Still another object of the invention is to provide device for air conditioning and refrigeration systems which subcools the liquid refrigerant thereby increasing its net refrigeration effect by reducing the refrigerant's sensible temperature.

5. Another object of the invention is to provide a method for reducing excessive air conditioning and refrigeration compressor head pressure thereby having the dual effect of increasing the compressor's mean time between failure and reducing the compressor's electric power consumption.

6. An object of the invention is to provide a method which recirculates cooling water through said heat exchanger and discharges the cooling water only after it reaches a predetermined temperature thereby maximizing the cooling capacity of the water and minimizing water consumption.

7. Another object of the invention is to provide a device which automatically shuts itself off and drains itself of water below a predetermined ambient temperature then subsequently automatically turns itself on and replenishes its water supply when the ambient temperature rises above a predetermined ambient temperature thereby protecting the device from frozen water damage during subfreezing ambient temperatures.

8. Yet another object of the invention is to provide a device which uses a readily cleanable coaxial or counterflow heat exchanger.

9. Still another object of the invention is to provide a device which can be adapted to perform with one or more air conditioning or refrigeration systems.

These objects of the invention are given only by way of example. Further objects and advantages will become apparent to those skilled in the art as the description proceeds. Nonetheless the scope of the invention is limited only by the appended claims.

SUMMARY OF THE INVENTION

Briefly stated, and in accordance with the embodiments of this invention, there is provided a device which reduces the electric energy consumption of air cooled air conditioning and refrigeration systems, said systems employing a compressor, condenser, expansion valve, and evaporator connected together by tubing through which flows a refrigerant in accordance with well understood prior art. The air cooled condenser removes approximately 88% of the total heat of the refrigeration process including all of the latent heat collected by the evaporator. This invention introduces a water to refrigerant heat exchanger in the refrigerant line between the condenser and the expansion valve in order to remove sensible heat from the refrigerant which is not necessarily dispersed by the air cooled condenser. This method of subcooling the refrigerant increases the refrigerant's capacity to collect heat during the evaporation process, thereby reducing the running time of the air conditioning or refrigeration system when such systems are properly employed in accordance with well understood principles of the art. In addition, this method of subcooling the refrigerant lowers the undesired elevated compressor head pressure which develops in prior art air cooled air conditioning and refrigeration systems, when said compressor and its associated condenser are situated in warm or hot ambient environments, thereby eliminating the excessive electric current needed by the compressor to overcome the undesired elevated compressor head pressure. The lowering of elevated compressor head pressure also reduces the mechanical strain on the compressor as employed in prior art air cooled air conditioning and refrigeration systems thereby increasing the expected mean time between failure of said systems.

The cooling water, used in this invention, is drawn from available water mains or wells and is circulated by the device between the water to refrigerant heat exchanger and a water storage tank which is oriented in such a way that warmer water collects near the top and cooler water collects near the bottom. The circulated water is withdrawn from the bottom and returns at the top of the water storage tank thus the relatively cooler water always is recirculated first making maximum use of the cooling capacity of the water at any moment in time. When the temperature of the water in the upper region of the water storage tank rises and reaches a predetermined point it is automatically discharged allowing cooler water from the water source to enter the device until the water temperature is the upper region of the water tank is lowered to a predetermined point. In this manner a minimum amount of water is consumed in the cooling process.

To those skilled in the art, it is clear that the cooling water subsystem can be attached to a multiplicity of water to refrigerant heat exchangers thereby achieving significant manufacturing economies in the configuration of the device.

The preferred embodiment of the invention contemplates locating the device outside where it may be subject to freezing ambient temperatures during certain times of the year. In anticipation of such an occurrence, the device automatically shuts itself off and drains the cooling water at a predetermined low ambient temperature and subsequently turns itself on and refills itself with cooling water as the ambient temperature rises and reaches a predetermined higher temperature.

Several beneficial options for disposing of the discharged water are disclosed in the various embodiments of this invention. In lieu of directly disposing of the discharged water in a drain, dry well or recharge water well, the preferred embodiment of this invention sprays the discharged water onto the roof of the building thereby, through evaporation of the water, reducing the heat load on the air conditioning refrigeration system with a consequent reduction in electric power consumed. The second embodiment of the invention takes advantage of the relatively large volume of hot water consumed in certain businesses such as restaurants. This embodiment discharges the warmed cooling water into a hot water heater tank whenever hot water is consumed in the normal operation of that business. This preheated water reduces the load on the hot water heater thereby reducing its energy consumption.

While the specification concludes with claims particularly pointing out and distinctly claiming the subject matter regarded as the invention, it is believed that the invention will be better understood from the following taken in connection with the accompanying drawings.

BRIEF DESCRIPTION OF THE DRAWINGS

Referring now to FIG. 1, which is the preferred embodiment of the invention, a typical prior art air conditioning and refrigeration system as understood by those practiced in the art, is depicted in summary by the elements of a compressor 1, condenser 2, expansion device 3, evaporator 4, and the connecting refrigerant lines 5. In this embodiment the refrigerant line 5, running from the condenser 2 to the expansion device 3 is diverted to a water to refrigerant heat exchanger 6 where refrigerant sensible temperature is given up to cooling water. During the period when the compressor 1 is running, this cooling water is circulated through water lines 7 from the water to refrigerant exchanger 6 to water storage tank 8 and thence back to the water to refrigerant heat exchanger 6. This water circulation is accomplished by water pump 9. The water storage tank 8 is oriented such that a water temperature gradient exists across the water storage tank 8 by placing the circulating water entry point 10 at a higher level than the circulating water exit point 11. By this means warmer water rises to the upper area of the water storage tank 8 and accumulates near aquastat 12 which at a preset temperature, typically in the 80° F. range, opens solenoid valve 13 allowing the heated water to be dispersed through one or more nozzles 14. As the heated water is dispensed it is automatically replaced by cool water which flows from the cool water source 15 through solenoid valve 16 which is maintained open by thermostat 17 when the ambient temperature remains above a preset temperature.

Figure 1:
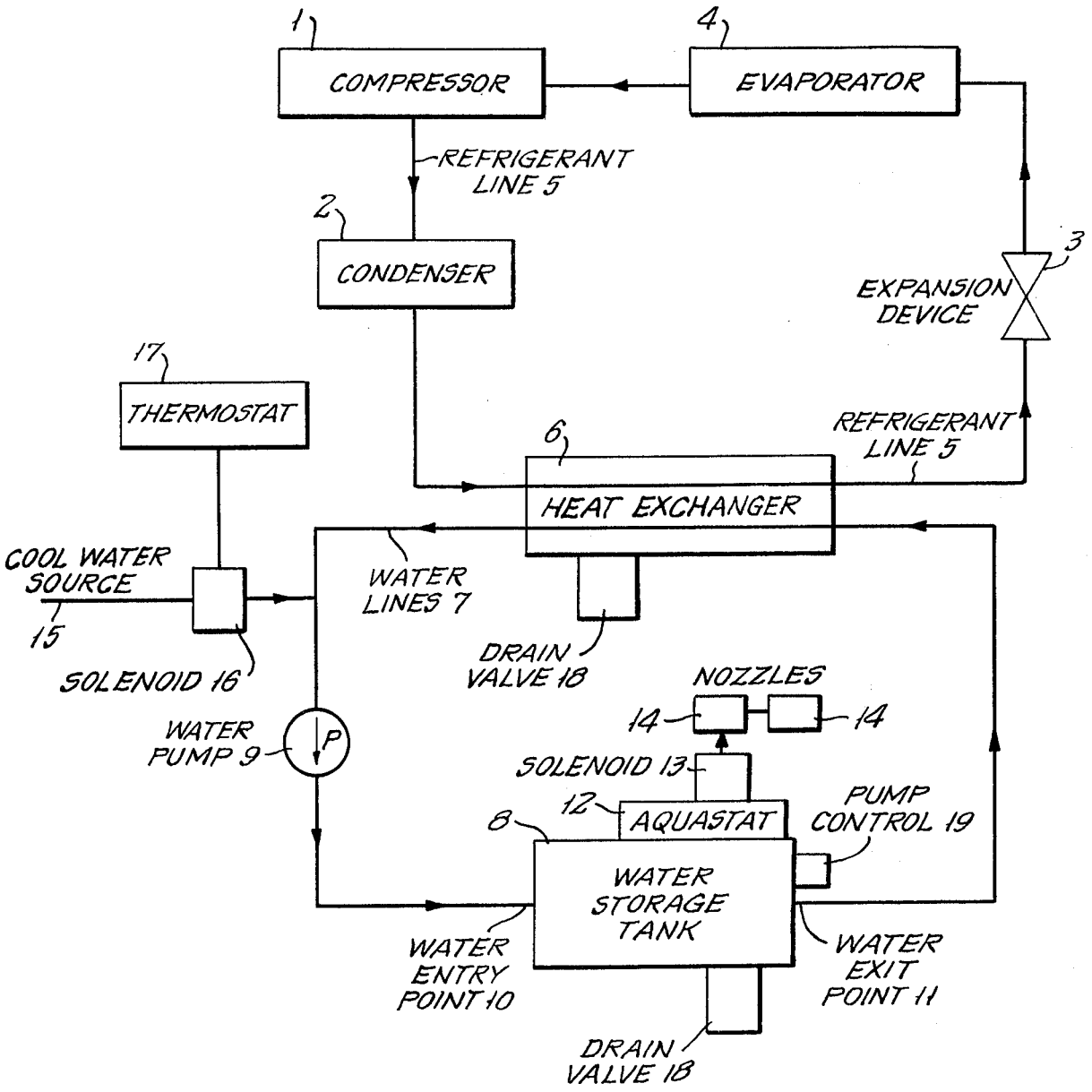
FIG. 1 is a schematic of the preferred embodiment of an air conditioning and refrigeration system in accordance with the invention.

The warm water discharged at solenoid valve 13 can be disposed of in any available drain system or recharge well but the preferred embodiment of the invention, depicted in FIG. 1, disperses this water through one or more nozzles 14 which are situated at strategic locations on the roof of the building containing the air conditioning or refrigeration system. A portion of this water, before running off, will evaporate and have a cooling effect on the interior of the building which reduces the load on installed air conditioning and refrigeration systems, thereby, further reducing the electric power consumed by said systems. It is important to situate nozzles 14 such that the water stream or spray is directed away from condenser 2 to avoid the well known potentially deleterious effects this water may have on the refrigeration system operation and the exposed refrigeration system components.

It is clear to those experienced in the art, that although not depicted in FIG. 1, said single water to refrigerant heat exchanger can be replaced with a multiplicity of water to refrigerant heat exchangers, wherein, each heat exchanger is dedicated to a separate air conditioning or refrigeration system by diverting the cooling water to a water intake manifold which leads to more than one heat exchanger, then subsequently after the cooling water flows through the heat exchangers, it once again flows into a single stream through a water collection manifold, thus achieving significant economies in manufacture and installation.

The preferred embodiment of the invention depicted in FIG. 1 is designed for outdoor use, and therefore, must be protected from freezing by automatically deactivating certain elements and draining the system of water during low temperature periods, then automatically reactivating the cooling system during warm temperature periods. This automatic feature is particularly important during certain seasons when the ambient temperature range is such that the system automatically cycles daily. Referring to FIG. 1, thermostat 17 senses an ambient temperature drop and at a preset temperature, typically 40° F., closes water solenoid valve 16 and opens water solenoid valve 13, thereby, isolating the system from the water pressure at the cool water source 15 and relieving the internal water pressure through the open water solenoid valve 13. This water pressure drop opens pressure responsive drain valves 18, thereby, draining through gravity the water from the water to refrigerant heat exchanger 6, the water pump 9, the water storage tank 8 and the water lines 7. Concurrently, when the water pressure drops in the water storage tank 8 the pressure sensitive pump control 19 deactivates water pump 9. Subsequently, as the ambient temperature rises, thermostat 17, at a second preset temperature, typically 70° F., opens water solenoid valve 16 which allows cooling water from the cool water source 15 to flow into the water to refrigerant heat exchanger 6, the water pump 9, the water storage tank 8 and the water lines 7. The rate at which the cooling water flows into said elements is greater than the rate at which the cooling water drains from drain valves 18. Accordingly, said elements are refilled with cool water. Just as said elements are refilled, the cooling water reaches Aquastat 12 which automatically closes water solenoid valve 13 and re-establishes water pressure, thereby, closing drain valves 18. When the pressurized water reaches pressure sensitive pump control 19, the pressure sensitive pump control 19 turns water pump 9 on.

Figure 2:
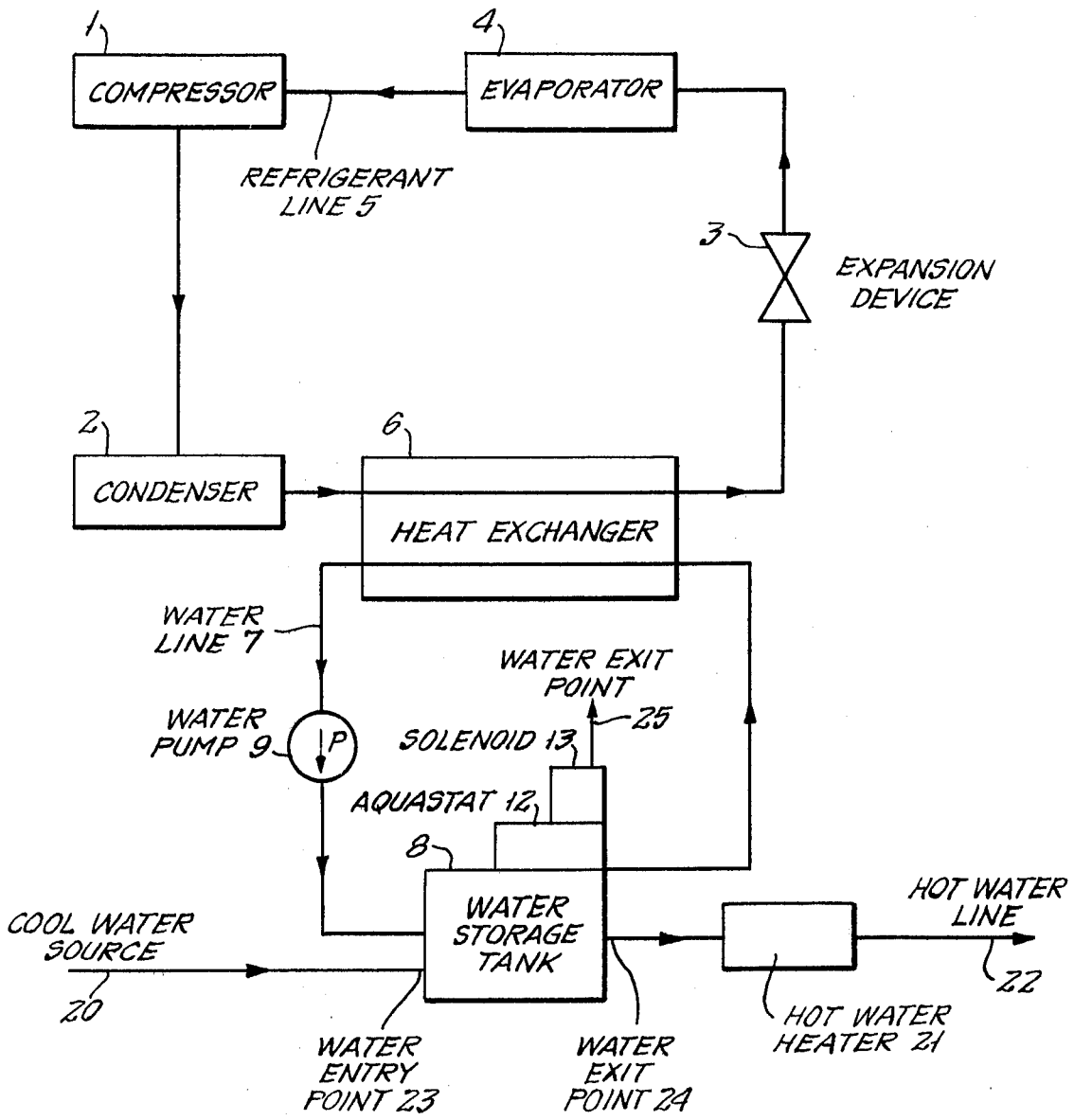
FIG. 2 is a schematic of a first modification of the FIG. 1 embodiment.

Some classes of business consume a large amount of water as a normal part of their operations. For example, many full service restaurants consume between 90 and 150 thousand gallons of water per month, much of which is used as hot water. The second embodiment of the invention takes advantage of these relatively large water requirements to improve the efficiency of existing air cooled air conditioning and refrigeration equipment. This embodiment has the added benefit of pre-heating water used in existing hot water systems, thereby, reducing the energy needed to heat water. Referring to FIG. 2, a prior art refrigeration system comprised of a compresser 1, condenser 2, expansion device 5, evaporator 4, and connecting refrigerant lines 5 is depicted. As in the preferred embodiment, a water to refrigerant heat exchanger 6 is incorporated into the refrigerant line 5 between the condenser 2 and the expansion device 3, a water pump 9 circulates cooling water through water lines 7 from the water to refrigerant heat exchanger 6 to water storage tank 8 and hence back to the water to refrigerant heat exchanger 6. In this second embodiment the cool water source 20 is the cold water line leading to an existing hot water heater 21. This cool water source 20 is diverted directly to a low point 23 in the water storage tank 8. Whenever water is drawn from hot water heater 21 through hot water line 22, it is replaced by pre-heated water from water storage tank 8. This preheated water exists from a high point 24 in the water storage tank 8. During periods when consumption of hot water drawn from the hot water heater 21 is low, the temperature of the water in the upper part of water storage tank 8 rises and is sensed by aquastat 12 which at a preset temperature opens water solenoid valve 13 allowing warm water to discharge at a water exit point 25. As warm water is discharged, it is automatically replaced by cool water from the cool water source 20. The net effect of this embodiment is to subcool the refrigerant and realize the air conditioning and refrigeration system efficiency improvements as in the preferred embodiment of the invention.

Having described the invention in sufficient detail to enable those skilled in the art to make and use it, I claim:

1. A refrigeration system including a compressor, a condenser, expansion means and an evaporator connected in a refrigerant flow relationship, and, additionally, a cooling water storage and recirculation system comprising: a heat exchanger connected between the condenser and the expansion means; a water storage tank; a pump; first temperature responsive control means operatively associated with the storage and recirculation system for preventing water flow therein responsive to sensing a predetermined low temperature and permitting flow therein responsive to sensing a predetermined high temperature, the first temperature responsive control means including a thermostat and a first solenoid valve; second temperature responsive control means operatively associated with the storage and recirculation system for relieving pressure therein responsive to sensing of a predetermined low temperature and increasing pressure therein responsive to sensing a predetermined high temperature, the second temperature responsive control means including an aquastat and a second solenoid valve; first pressure responsive control means operatively associated with the heat exchanger for draining water from the storage and recirculation system upon sensing a predetermined low water pressure therein and for retaining water in the system upon sensing a predetermined high water pressure therein, the first pressure responsive control means including a first drain valve; second pressure responsive control means operatively associated with the water storage tank for draining water from the storage and recirculation system upon sensing a predetermined low water pressure and retaining water therein upon sensing a predetermined high water pressure, the second pressure responsive control means including a second drain valve; and, a pressure sensitive pressure responsive pump control means for activating said pump to add water to the system upon sensing a water pressure above a preselected high value and for deactivating said pump to drain water from the system upon sensing a water pressure below a preselected low value whereby cooler water is automatically drained from the storage and recirculation system at a preselected low temperature and warmer water is automatically added to the storage and recirculation system at a preselected high temperature.

2. The refrigeration system of claim 1 and further comprising a hot water heater and an associated hot water line and wherein said second pressure responsive control means including said second drain valve is operative to connect the line to the heater upon sensing a preselected low water pressure whereby warm water to be drained from the system is discharged into a related hot water heater.

* * * * *